US006776677B1

(12) United States Patent
Knapp, Jr.

(10) Patent No.: US 6,776,677 B1
(45) Date of Patent: Aug. 17, 2004

(54) ENGINE FLUSHING DEVICE AND METHOD OF USING

(76) Inventor: Dallas L. Knapp, Jr., 16277 Wildwood Valley, Cedar Springs, MI (US) 49319

( * ) Notice: Subject to any disclaimer, the term of this patent is extended or adjusted under 35 U.S.C. 154(b) by 0 days.

(21) Appl. No.: 10/441,301

(22) Filed: May 15, 2003

(51) Int. Cl.[7] ..... B63H 21/38
(52) U.S. Cl. ..... 440/88 N
(58) Field of Search ..... 440/88, 88 R, 440/88 C, 88 N; 134/22.11, 22.12, 22.18, 166 R, 166 C

(56) References Cited

U.S. PATENT DOCUMENTS 3,188,006 A * 6/1965 Falk ..... 237/8 R
4,121,948 A * 10/1978 Guhlin ..... 134/100.1
4,646,775 A * 3/1987 Traylor ..... 137/218
5,350,329 A * 9/1994 Haman ..... 440/88 R
5,362,265 A * 11/1994 Gervais ..... 440/88 R
6,695,660 B1 * 2/2004 Ellis ..... 440/88 C

* cited by examiner

*Primary Examiner*—Sherman Basinger

(57) ABSTRACT

An engine flushing device and an associated method of using the device for use in purging trapped water within the cooling chamber of an engine are disclosed. The device includes a connector attachable to an output of a garden hose; a conduit; a shutoff valve having a shutoff gate; a fluid entry valve having a fluid entry gate; and a tube which is operationally attachable to the intake port of the engine. The method includes the steps of adjoining, affixing, aligning, conjoining, connecting, coupling, lining, mating, moving, obtaining, placing, positioning, running, and turning.

13 Claims, 3 Drawing Sheets

ENGINE FLUSHING DEVICE AND METHOD OF USING

FIELD OF THE INVENTION

The present invention relates to engine maintenance devices, more particularly to a device for flushing water cooling systems and winterizing these same systems for marine engines.

DESCRIPTION OF THE PRIOR ART

Efforts are constantly being taken to improve fresh water flushing systems for marine engines, due to the degrading effects of corrosion brought about by salt within the confines of the water cooling systems of the engines. Fresh water flushing systems is strongly recommended universally by every single marine engine manufacturer because flushing fresh water through a marine engine substantially prolongs the life of the equipment, lowers the maintenance costs, and consequently protects the significant investment in the engine itself. It is also well known that any water cooled engine should be also be protected against freezing because of the threat of a cracked block brought about by increase in the volume of water when shifting from the water phase to the solid phase, i.e., freezing. Prior art devices and techniques range from the simple to the complex. For example, a garden hose can be plumbed into a marine engine and subsequently be used to flush the salt water within the engine with fresh water. Another example might simply be opening up a drain valve on the engine. Traditional flushing systems currently available are time consuming to use, error prone, and in many cases just not feasible to use for commercial crafts or pleasure crafts.

A wide variety of engine flushing devices is currently available on the commercial market and an even larger number of these types of devices are known in the art of engine flushing, for example, the purge valve for cooling fluid conduit systems disclosed by Maxon in U.S. Pat. No. 3,550,612; the fresh water flushing kit disclosed by Patti in U.S. Pat. No. 4,619,618; the flushing valve for inboard boat engines disclosed by Parker in U.S. Pat. No. 5,295,880; the fresh water flushing system disclosed by Brogdon in U.S. Pat. No. 5,393,252; the mini fresh water flushing device disclosed by Brogdon in U.S. Pat. No. 5,830,023; and the chemical dispenser valve for a boat engine flusher disclosed by Peeples in U.S. Pat. No. D368,129.

While all of the above-described devices fulfill their respective, particular objectives and requirements, the aforementioned patents do not describe an engine flushing device having a connector attachable to an output of a garden hose; a conduit; a shutoff valve having a shutoff gate; a fluid entry valve having a fluid entry gate; and a tube which is operatively attachable to the intake port of the engine. This combination of elements would specifically match the user's particular individual needs of making it possible to conveniently winterize and flush a marine engine by performing the steps of adjoining, affixing, aligning, conjoining, connecting, coupling, lining, mating, moving, obtaining, placing, positioning, running, and turning. The above-described patents make no provision for an engine flushing device having a connector attachable to an output of a garden hose; a conduit; a shutoff valve having a shutoff gate; a fluid entry valve having a fluid entry gate; and a tube which is operatively attachable to the intake port of the engine.

Therefore, a need exists for a new and improved engine flushing device having a connector attachable to an output of a garden hose; a conduit; a shutoff valve having a shutoff gate; a fluid entry valve having a fluid entry gate; and a tube which is operatively attachable to the intake port of the engine. In this respect, the engine flushing device according to the present invention substantially departs from the conventional concepts and designs of the prior art, and in doing so provides an apparatus primarily developed for the purpose of providing a convenient means for winterizing and/or flushing a marine engine by performing the steps of adjoining, affixing, aligning, conjoining, connecting, coupling, lining, mating, moving, obtaining, placing, positioning, running, and turning.

SUMMARY OF THE INVENTION

The present device and associated method of using, according to the principles of the present invention, overcomes the shortcomings of the prior art by providing a engine flushing device and an associated method. The device includes a connector attachable to an output of a garden hose; a conduit; a shutoff valve having a shutoff gate; a fluid entry valve having a fluid entry gate; and a tube which is operatively attachable to the intake port of the engine. The method includes the steps of adjoining, affixing, aligning, conjoining, connecting, coupling, lining, mating, moving, obtaining, placing, positioning, running, and turning.

In view of the foregoing disadvantages inherent in the known type engine flushing devices now present in the prior art, the present invention provides an improved engine flushing device, which will be described subsequently in great detail, is to provide a new and improved engine flushing device which is not anticipated, rendered obvious, suggested, or even implied by the prior art, either alone or in any combination thereof.

To attain this, the present invention essentially comprises a connector attachable to an output of a garden hose; a conduit; a shutoff valve having a shutoff gate; a fluid entry valve having a fluid entry gate; and a tube which is operatively attachable to the intake port of the engine.

There has thus been outlined, rather broadly, the more important features of the invention in order that the detailed description thereof that follows may be better understood, and in order that the present contribution of the art may be better appreciated.

The invention may also include an optional funnel. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved engine flushing device that has all the advantages of the prior art engine flushing device and none of the disadvantages.

It is another object of the present invention to provide a new and improved engine flushing device that may be easily and efficiently manufactured and marketed.

An even further object of the present invention is to provide a new and improved engine flushing device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new engine flushing device that provides in the apparatuses and methods of the prior art some of the advantages thereof, while simultaneously overcoming some of the disadvantages normally associated therewith.

Even still another object of the present invention is to provide a engine flushing device having a connector attachable to an output of a garden hose; a conduit; a shutoff valve having a shutoff gate; a fluid entry valve having a fluid entry gate; and a tube which is operatively attachable to the intake port of the engine. This combination of elements makes it possible to conveniently winterize and flush a marine engine by performing the steps of adjoining, affixing, aligning, conjoining, connecting, coupling, lining, mating, moving, obtaining, placing, positioning, running, and turning.

Lastly, it is an object of the present invention to provide a new and improved method of using comprising the steps of adjoining, affixing, aligning, conjoining, connecting, coupling, lining, mating, moving, obtaining, placing, positioning, running, and turning.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
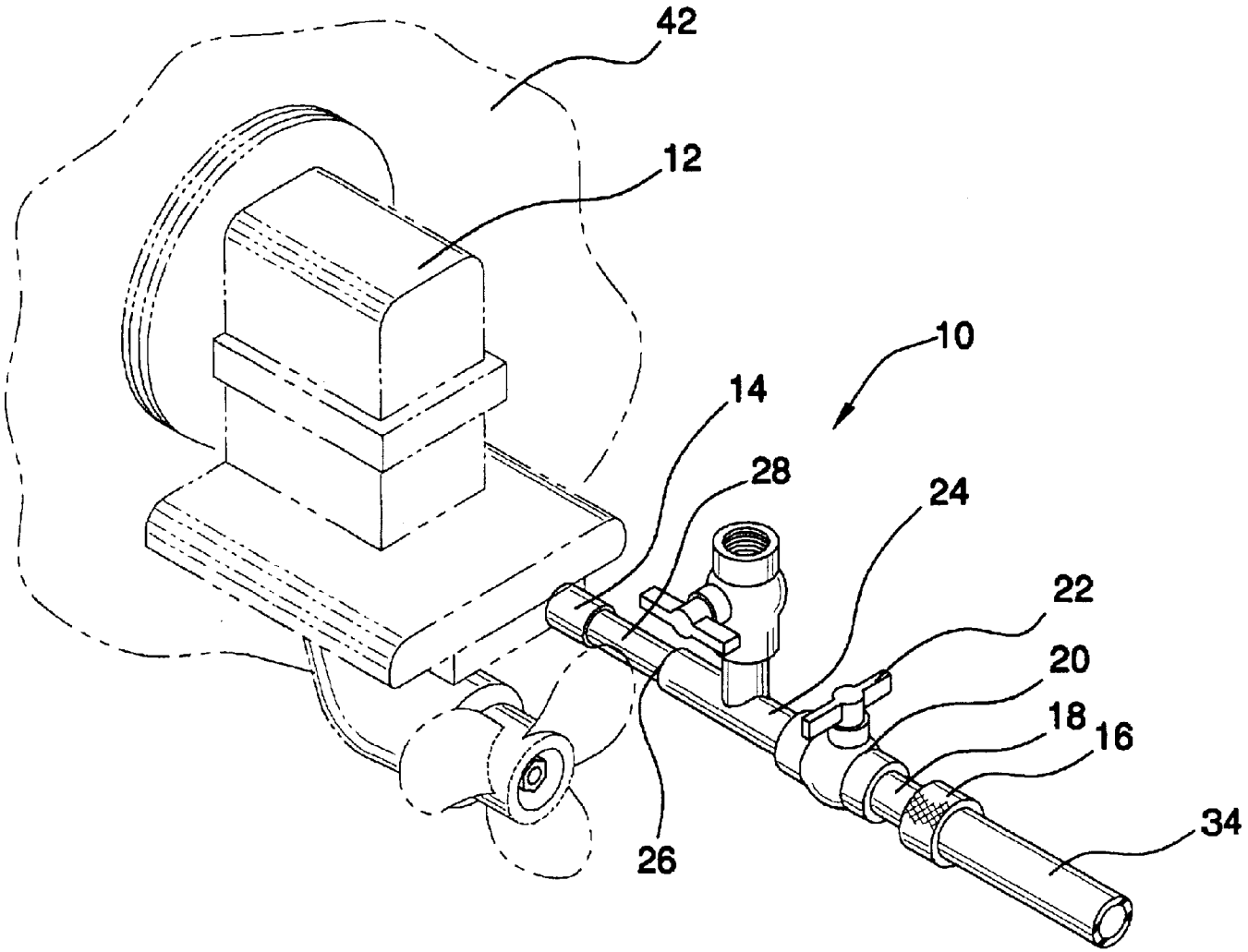
FIG. 1 is a perspective view of a preferred embodiment of the engine flushing device constructed in accordance with the principles of the present invention.
Figure 2:
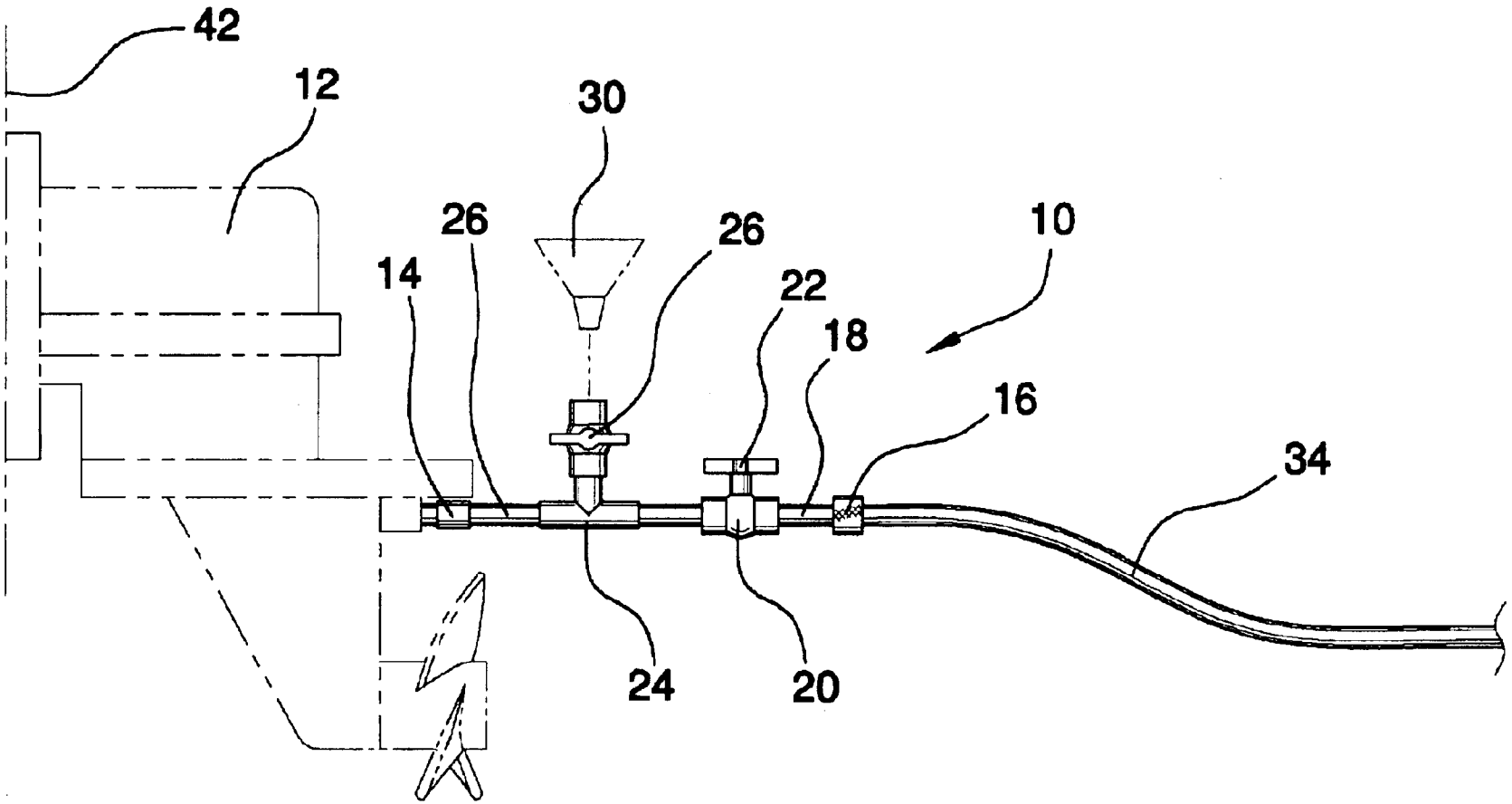
FIG. 2 is a side view of a preferred embodiment of the engine flushing device of the present invention.
Figure 3:
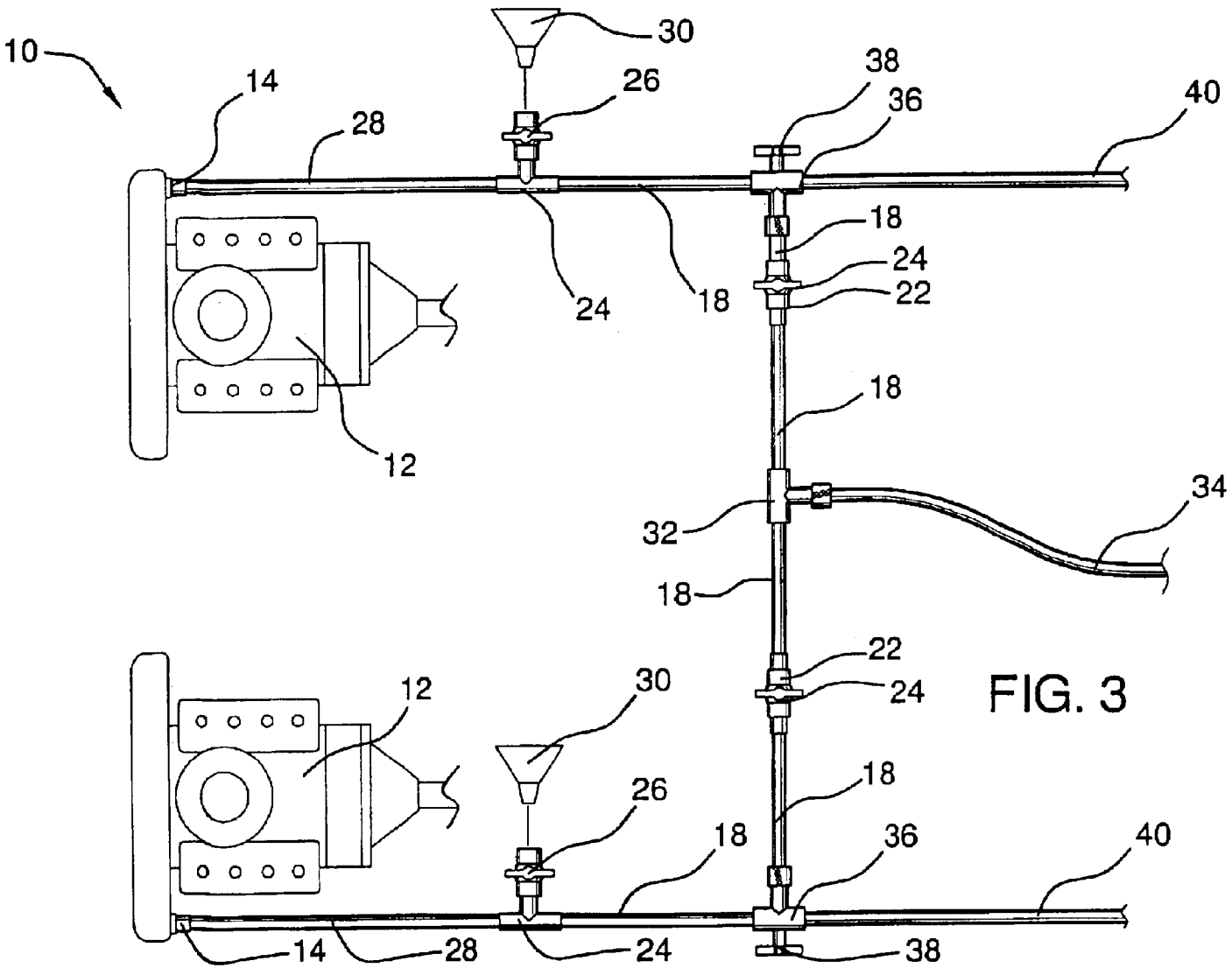
FIG. 3 is a top view of a preferred embodiment of the engine flushing device of the present invention.

Referring now to the drawings, and in particular FIG. 1 to 3 thereof, one preferred embodiment of the present invention is shown and generally designated by the reference numeral 10. One preferred embodiment of an engine flushing device 10 for use in purging trapped water within the cooling chamber of an engine 12 having an intake port 14, such as an inboard or inboard/outboard marine motor, said engine flushing device 10 comprising: a dual-junction connector 16 having a input and an output, the input is operatively attachable to an output of a garden hose 34; a first conduit 18 having an input and an output, the input of said first conduit 18 is operatively attached to the output of said dual-junction connector 16; a shutoff valve 20 having an input, an output and a shutoff gate 22, the inlet of the said shutoff valve 20 is operatively attached to the output of said first conduit 18, when the shutoff gate 22 of the shutoff valve 20 is positioned in an open position then the inlet and outlet of said shutoff valve 20 are in fluid communications with each other, when the shutoff gate 22 of the shutoff valve 20 is positioned in a closed position then the inlet and outlet of the shutoff valve 20 are not in fluid communications with each other; a fluid entry valve 24 having a first inlet, a second inlet, an outlet, and a fluid entry gate 26, the first inlet of the fluid entry valve 24 is operatively attached to the outlet of the shutoff valve 20, when the fluid entry gate 26 of the fluid entry valve 24 is positioned in a detour position then the first inlet of the fluid entry valve 24 is in fluid communications with the outlet of said fluid entry valve 24, when the fluid entry gate 26 of the fluid entry valve 24 is positioned in a fluid introduction position then the second inlet of said fluid entry valve 24 is in fluid communications with the outlet of said fluid entry valve 24; and a tube 28 having an inlet and an outlet, the inlet of said tube 28 is operatively attached to the outlet of said fluid entry gate 26, the outlet of said tube 28 is operatively attachable to the intake port 14 of the engine 12.

An optional funnel 30 may be added to the device 10. The funnel 30 has a bottom and a top, wherein the bottom of said funnel 30 is operatively attachable to the second inlet of said fluid entry valve 24 of the device 10.

The device may be made of any type of material as long as it is water resistant. One preferred configuration of the device 10 is that it is made of plastic selected from is made of plastic selected from the group consisting of polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

Another preferred embodiment of the engine flushing device 10 for purging existing water trapped within respective cooling chambers of a first and second engines 12, the first and second engines 12 having respective first and second intake port s 14 connected to respective first and second onboard cooling lines 40, said device 10 comprising: a tri-junction conduit connector 32 having a first outlet, a second outlet and an inlet, the inlet of said tri-junction conduit connector 32 is operatively attachable to an outlet of a garden hose 34; a first conduit 18 having an inlet and an outlet, the inlet of said first conduit 18 is operatively attached to the first outlet said tri-junction conduit connector 32; a first shutoff valve 20 having an inlet, an outlet and a first shutoff gate 22, the inlet of said first shutoff valve 20 is operatively attached to the outlet of said first conduit 18, when the first shutoff gate 22 of said first shutoff valve 20 is positioned in a first open position then the inlet and outlet of said first shutoff valve 20 are in fluid communications with each other, when the first shutoff gate 22 of said first shutoff valve 20 is positioned in a first closed position then the inlet and outlet of said first shutoff valve 20 are not in fluid communications with each other; a first bypass valve 36 having a first inlet, a second inlet, an outlet, and a first bypass gate 38, the first inlet of said first bypass valve 36 is operatively attached to the outlet of said first shutoff valve 20, the second inlet of said first bypass valve 36 is operatively attachable to an outlet of the first onboard cooling line 40, when the first bypass gate 38 of said first bypass valve 36 is positioned in a first bypass position then the first inlet of the first bypass valve 36 is in fluid communications with the outlet of said first shutoff valve 20, when the first bypass gate 38 of said first bypass valve 36 is positioned in a first flow through position and when the second inlet of said first bypass valve 36 is operatively attached to the outlet of the first onboard cooling line 40 then the second inlet of the first bypass valve 36 is in fluid communications with the outlet of the first onboard cooling line 40; a first fluid entry valve 24 having a first inlet, a second inlet, an outlet and a first fluid entry gate 26, the first inlet of said first fluid entry valve 24 is operatively attached to the outlet of said first bypass valve 36, when the first fluid entry gate 26 of said first fluid entry valve 24 is positioned in a first detour position then the first inlet of said first fluid entry valve 24 is in fluid communications with the outlet of said first fluid entry valve 24, when the first fluid entry gate 26 of said first fluid entry valve 24 is positioned in an first fluid introduction position then the second inlet of said first fluid entry valve 24 is in fluid communications with the outlet of said first fluid entry valve 24; a first tube 28 having an inlet and an outlet, the inlet of said first tube 28 is operatively attached to the outlet said first fluid entry valve 24, the outlet of said first tube 28 is operatively attachable to the first intake port 14 of the first engine 12; a second conduit 18 having an inlet and an outlet, the inlet of said second conduit 18 is operatively attached to the second outlet said tri-junction conduit connector 32; a second shutoff valve 20 having an inlet, an outlet and a second shutoff gate 22, the inlet of said second shutoff valve 20 is operatively attached to the outlet of said second conduit 18, when the second shutoff gate 22 of said second shutoff valve 20 is positioned in a second open position then the inlet and outlet of said second shutoff valve 20 are in fluid communications with each other, when the second shutoff gate 22 of said second shutoff valve 20 is positioned in a second closed position then the inlet and outlet of said second shutoff valve 20 are not in fluid communications with each other; a second bypass valve 36 having a first inlet, a second inlet, an outlet, and a second bypass gate 38, the first inlet of said second bypass valve 36 is operatively attached to the outlet of said second shutoff valve 20, the second inlet of said second bypass valve 36 is operatively attachable to an outlet of the second onboard cooling line 40, when the second bypass gate 38 of said second bypass valve 36 is positioned in a second bypass position then the first inlet of the second bypass valve 36 is in fluid communications with the outlet of said second shutoff valve 20, when the second bypass gate 38 of said second bypass valve 36 is positioned in a second flow through position and when the second inlet of said second bypass valve 36 is operatively attached to the outlet of the second onboard cooling line 40 then the second inlet of the second bypass valve 36 is in fluid communications with the outlet of the second onboard cooling line 40; a second fluid entry valve 24 having a first inlet, a second inlet, an outlet and a second fluid entry gate 26, the first inlet of said second fluid entry valve 24 is operatively attached to the outlet of said second bypass valve 36, when the second fluid entry gate 26 of said second fluid entry valve 24 is positioned in a second detour position then the first inlet of said second fluid entry valve 24 is in fluid communications with the outlet of said second fluid entry valve 24, when the second fluid entry gate 26 of said second fluid entry valve 24 is positioned in a second fluid introduction position then the second inlet of said second fluid entry valve 24 is in fluid communications with the outlet of said second fluid entry valve 24; and a second tube 28 having an inlet and an outlet, the inlet of said second tube 28 is operatively attached to the outlet said second fluid entry valve 24, the outlet of said second tube 28 is operatively attachable to the second intake port 14 of the second engine 12.

The tri-junction conduit 18 may be any type of tri-junction conduit 18 such as a T-junction conduit 18 or a Y-junction conduit 18.

One preferred embodiment of a method of using an engine flushing device 10 for purging existing water trapped within respective cooling chambers of a first and second engines 12 of a boat 42, the first and second engines 12 having respective first and second intake ports 14 connected to respective first and second onboard cooling lines 40, said method comprising the steps of: adjoining, affixing, aligning, conjoining, connecting, coupling, lining, mating, moving, obtaining, placing, positioning, running, and turning. The obtaining step comprises obtaining the engine flushing device 10 comprising: a tri-junction conduit connector 32 having a first outlet, a second outlet and an inlet, the inlet of the tri-junction conduit connector 32 is operatively attachable to an outlet of a garden hose 34; a first conduit 18 having an inlet and an outlet, the inlet of the first conduit 18 is operatively attached to the first outlet the tri-junction conduit connector 32; a first shutoff valve 20 having an inlet, an outlet and a first shutoff gate 22, the inlet of the first shutoff valve 20 is operatively attached to the outlet of the first conduit 18, when the first shutoff gate 22 of the first shutoff valve 20 is positioned in a first open position then the inlet and outlet of the first shutoff valve 20 are in fluid communications with each other, when the first shutoff gate 22 of the first shutoff valve 20 is positioned in a first closed position then the inlet and outlet of the first shutoff valve 20 are not in fluid communications with each other; a first bypass valve 36 having a first inlet, a second inlet, an outlet, and a first bypass gate 38, the first inlet of the first bypass valve 36 is operatively attached to the outlet of the first shutoff valve 20, the second inlet of the first bypass valve 36 is operatively attachable to an outlet of the first onboard cooling line 40, when the first bypass gate 38 of the first bypass valve 36 is positioned in a first bypass position then the first inlet of the first bypass valve 36 is in fluid communications with the outlet of the first shutoff valve 20, when the first bypass gate 38 of the first bypass valve 36 is positioned in a first flow through position and when the second inlet of the first bypass valve 36 is operatively attached to the outlet of the first onboard cooling line 40 then the second inlet of the first bypass valve 36 is in fluid communications with the outlet of the first onboard cooling line 40; a first fluid entry valve 24 having a first inlet, a second inlet, an outlet and a first fluid entry gate 26, the first inlet of the first fluid entry valve 24 is operatively attached to the outlet of the first bypass valve 36, when the first fluid entry gate 26 of the first fluid entry valve 24 is positioned in a first detour position then the first inlet of the first fluid entry valve 24 is in fluid communications with the outlet of the first fluid entry valve 24, when the first fluid entry gate 26 of the first fluid entry valve 24 is positioned in an first fluid introduction position then the second inlet of the first fluid entry valve 24 is in fluid communications with the outlet of the first fluid entry valve 24; a first tube 28 having an inlet and an outlet, the inlet of the first tube 28 is operatively attached to the outlet the first fluid entry valve 24, the outlet of the first tube 28 is operatively attachable to the first intake port 14 of the first engine 12; a second conduit 18 having an inlet and an outlet, the inlet of the second conduit 18 is operatively attached to the second outlet the tri-junction conduit connector 32; a second shutoff valve 20 having an inlet, an outlet and a second shutoff gate 22, the inlet of the second shutoff valve 20 is operatively attached to the outlet of the second conduit 18, when the second shutoff gate 22 of the second shutoff valve 20 is positioned in a second open position then the inlet and outlet of the second shutoff valve 20 are in fluid communications with each other, when the second shutoff gate 22 of the second shutoff valve 20 is positioned in a second closed position then the inlet and outlet of the second shutoff valve 20 are not in fluid communications with each other; a second bypass valve 36 having a first inlet, a second inlet, an outlet, and a second bypass gate 38, the first inlet of the second bypass valve 36 is operatively attached to the outlet of the second shutoff valve 20, the second inlet of the second bypass valve 36 is operatively attachable to an outlet of the second onboard cooling line 40, when the second bypass gate 38 of the second bypass valve 36 is positioned in a second bypass position then the first inlet of the second bypass valve 36 is in fluid communications with the outlet of the second shutoff valve 20, when the second bypass gate 38 of the second bypass valve 36 is positioned in a second flow through position and when the second inlet of the second bypass valve 36 is operatively attached to the outlet of the second onboard cooling line 40 then the second inlet of the second bypass valve 36 is in fluid communications with the outlet of the second onboard cooling line 40; a second fluid entry valve 24 having a first inlet, a second inlet, an outlet and a second fluid entry gate 26, the first inlet of the second fluid entry valve 24 is operatively attached to the outlet of the second bypass valve 36, when the second fluid entry gate 26 of the second fluid entry valve 24 is positioned in a second detour position then the first inlet of the second fluid entry valve 24 is in fluid communications with the outlet of the second fluid entry valve 24, when the second fluid entry gate 26 of the second fluid entry valve 24 is positioned in a second fluid introduction position then the second inlet of the second fluid entry valve 24 is in fluid communications with the outlet of the second fluid entry valve 24; a second tube 28 having an inlet and an outlet, the inlet of the second tube 28 is operatively attached to the outlet the second fluid entry valve 24, the outlet of the second tube 28 is operatively attachable to the second intake port 14 of the second engine 12. The adjoining step comprises adjoining operatively together the second inlet of the first bypass valve 36 of the device 10 to the outlet of the first onboard cooling line 40. The affixing step comprises affixing operatively together the second inlet of the second bypass valve 36 of the device 10 to the outlet of the second onboard cooling line 40. The conjoining step comprises conjoining operatively together the outlet of the first tube 28 of the device 10 to the first intake port 14 of the first engine 12. The coupling step comprises coupling operatively together the outlet of the second tube 28 of the device 10 to the second intake port 14 of the second engine 12, wherein said steps of adjoining, affixing, conjoining, and coupling comprise attaching the device 10 onto the boat 42. The connecting step comprises connecting operatively together an inlet of the garden hose 34 to a water faucet. The mating step comprises mating operatively together the outlet of the garden hose 34 to the inlet of the tri-junction conduit connector 32 of the attached device 10. The aligning step comprises aligning the first shutoff gate 22 of the first shutoff valve 20 of the attached device 10 into the first open position. The placing step comprises placing the first bypass gate 38 of the first bypass valve 36 of the attached device 10 in the first bypass position. The positioning step comprises positioning the second bypass gate 38 of the second bypass valve 36 of the attached device 10 in the second bypass position. The moving step comprises moving the first fluid entry gate 26 of the first fluid entry valve 24 of the attached device 10 in the first detour position. The lining step comprises lining up the second fluid entry gate 26 of the second fluid entry valve 24 of the attached device 10 in the second detour position, wherein said steps of aligning, lining, mating, placing, and positioning comprise configuring the attached device 10 into a flushing mode. The turning step comprises turning on the water faucet when the device 10 is in the flushing mode. The running step comprises running the first and second engines 12 when the device 10 is in the flushing mode, said step of running is performed subsequent to said turning step.

An additional set of steps may be added to the above described method comprising the steps of dispensing, finding, getting, mounting, pouring, putting, realigning, re-moving, reposing, and setting. The finding step comprises finding a first funnel 30 having a bottom end. The getting step comprises getting a winterizing solution. The mounting step comprises mounting operatively the bottom end of the first funnel 30 to the second inlet of the first fluid entry valve 24 of the attached device 10. The pouring step comprises pouring an aliquot of the winterizing solution into the first funnel 30 operatively mounted to the second inlet of the first fluid entry valve 24 of the attached device 10. The placing step comprises placing the first bypass gate 38 of the first bypass valve 36 of the attached device 10 in the first fluid introduction position when the first funnel 30 is operatively mounted to the second inlet of the first fluid entry valve 24 of the attached device 10 and when pouring the aliquot of the wintering solution into the first funnel 30 while running the first engine 12. The re-moving step comprises re-moving the first fluid entry gate 26 of the first fluid entry valve 24 of the attached device 10 in the first detour position, said re-moving step performed subsequent to said placing step. The reposing step comprises reposing operatively the bottom end of the first funnel 30 to the second inlet of the second fluid entry valve 24 of the attached device 10. The dispensing step comprises dispensing a portion of the winterizing solution into the first funnel 30 operatively reposed to the second inlet of the second valve of the attached device 10. The setting step comprises setting the second bypass gate 38 of the second bypass valve 36 of the attached device 10 in the second fluid introduction position when the first funnel 30 is operatively reposed to the second inlet of the second fluid entry valve 24 of the attached device 10 and when dispensing the portion of the winterizing solution into the first funnel 30 while running the second engine 12. The realigning step comprises realigning the second fluid entry gate 26 of the second fluid entry valve 24 of the attached device 10 in the second detour position, said re-lining up step performed subsequent to said setting step.

An optional step to the above described method may be added step of disconnecting, wherein the disconnecting step comprises disconnecting operatively the outlet of the garden hose 34 from the inlet of the tri-junction conduit connector 32 of the attached device 10.

An additional set of steps may be further added to the above described method comprising the steps of: assuring, rotating, switching, turning, twisting, and verifying. The switching step comprises switching the first shutoff gate 22 of the first shutoff valve 20 of the attached device 10 from the first open position to the first closed position. The pivoting step comprises pivoting the second shutoff gate 22 of the second shutoff valve 20 of the attached device 10 from the second open position to the second closed position. The twisting step comprises twisting the first bypass gate 38 of the first bypass valve 36 of the attached device 10 from the first bypass position to the first flow through position. The rotating step comprises rotating the second bypass gate 38 of the second bypass valve 36 of the attached device 10 from the second bypass position to the second flow through position. The assuring step comprises assuring that the first fluid entry valve 24 is in the first detour position. The verifying step comprises verifying that the second fluid entry valve 24 of the attached device 10 is in the second detour position.

An additional set of steps may be added to the above described method comprising the step of driving. The driving step comprises driving the boat 42 in a body of water when the first shutoff gate 22 of the first shutoff valve 20 of the attached device 10 is in the first closed position, when the second shutoff gate 22 of the second shutoff valve 20 of the attached device 10 is in the second closed position, when the first bypass gate 38 of the first bypass valve 36 of the attached device 10 is in the first flow through position, and when the second bypass gate 38 of the second bypass valve 36 of the attached device 10 is in the second flow through position.

Another preferred embodiment of the method consists of the steps of: adjoining, affixing, aligning, conjoining, connecting, coupling, lining, mating, moving, obtaining, placing, positioning, running, and turning.

Still another preferred embodiment of the method consists of the steps of adjoining, affixing, aligning, conjoining, connecting, coupling, dispensing, finding, getting, lining, mating, mounting, moving, obtaining, placing, positioning, pouring, putting, realigning, re-moving, reposing, running, setting, and turning.

Yet another preferred embodiment of the method consists of the steps of adjoining, affixing, aligning, conjoining, connecting, coupling, disconnecting, dispensing, finding, getting, lining, mating, mounting, moving, obtaining, placing, positioning, pouring, putting, realigning, re-moving, reposing, running, setting, and turning.

Still yet another preferred embodiment of the method consists of the steps of adjoining, affixing, aligning, assuring, conjoining, connecting, coupling, disconnecting, dispensing, finding, getting, lining, mating, mounting, moving, obtaining, pivoting, placing, positioning, pouring, putting, realigning, re-moving, reposing, rotating, running, setting, switching, turning, twisting, verifying Even yet another preferred embodiment of the method consists of the steps of adjoining, affixing, aligning, assuring, conjoining, connecting, coupling, disconnecting, dispensing, driving, finding, getting, lining, mating, mounting, moving, obtaining, pivoting, placing, positioning, pouring, putting, realigning, re-moving, reposing, rotating, running, setting, switching, turning, twisting, verifying Referring now to FIG. 1 and FIG. 2 which depicts a perspective view of a preferred embodiment of the engine flushing device 10 showing a dual-junction connector 16 having a input and an output, the input is operatively attached to an output of a garden hose 34; a first conduit 18 having an input and an output; a shutoff valve 20 having an input, an output and a shutoff gate 22; a fluid entry valve 24 having a first inlet, a second inlet, an outlet, and a fluid entry gate 26; and a tube 28 having an inlet and an outlet. Also shown is an engine 12 attached to a boat 42.

Referring now to FIG. 3 which depicts a top view of a preferred embodiment of the engine flushing device 10 showing a tri-junction conduit connector 32, a first conduit 18; a first shutoff valve 20 having an inlet, an outlet and a first shutoff gate 22; a first bypass valve 36 having a first inlet, a second inlet, an outlet, and a first bypass gate 38; a first fluid entry valve 24 having a first inlet, a second inlet, an outlet and a first fluid entry gate 26; a first tube 28 having an inlet and an outlet; a second conduit 18 having an inlet and an outlet; a second shutoff valve 20 having an inlet, an outlet and a second shutoff gate 22; a second bypass valve 36 having a first inlet, a second inlet, an outlet, and a second bypass gate 38; a second fluid entry valve 24 having a first inlet, a second inlet, an outlet and a second fluid entry gate 26; and a second tube 28 having an inlet and an outlet. Also shown are dual engines 12 attached to a boat 42.

As to the manner of usage and operation of the present invention, the sane should be apparent from the above description. Accordingly, no further discussion relating to the manner of usage and operation will be provided.

While a preferred embodiment of the engine flushing device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An engine flushing device for purging existing water trapped within respective cooling chambers of a first and second engines, the first and second engines having respective first and second intake ports connected to respective first and second onboard cooling lines, said device comprising:

a tri-junction conduit connector having a first outlet, a second outlet and an inlet, the inlet of said tri-junction conduit connector is operatively attachable to an outlet of a garden hose;

a first conduit having an inlet and an outlet, the inlet of said first conduit is operatively attached to the first outlet said tri-junction conduit connector;

a first shutoff valve having an inlet, an outlet and a first shutoff gate, the inlet of said first shutoff valve is operatively attached to the outlet of said first conduit, when the first shutoff gate of said first shutoff valve is positioned in a first open position then the inlet and outlet of said first shutoff valve are in fluid communications with each other, when the first shutoff gate of said first shutoff valve is positioned in a first closed position then the inlet and outlet of said first shutoff valve are not in fluid communications with each other;

a first bypass valve having a first inlet, a second inlet, an outlet, and a first bypass gate, the first inlet of said first bypass valve is operatively attached to the outlet of said first shutoff valve, the second inlet of said first bypass valve is operatively attachable to an outlet of the first onboard cooling line, when the first bypass gate of said first bypass valve is positioned in a first bypass position then the first inlet of the first bypass valve is in fluid communications with the outlet of said first shutoff valve, when the first bypass gate of said first bypass valve is positioned in a first flow through position and when the second inlet of said first bypass valve is operatively attached to the outlet of the first onboard cooling line then the second inlet of the first bypass valve is in fluid communications with the outlet of the first onboard cooling line;

a first fluid entry valve having a first inlet, a second inlet, an outlet and a first fluid entry gate, the first inlet of said first fluid entry valve is operatively attached to the outlet of said first bypass valve, when the first fluid entry gate of said first fluid entry valve is positioned in a first detour position then the first inlet of said first fluid entry valve is in fluid communications with the outlet of said first fluid entry valve, when the first fluid entry gate of said first fluid entry valve is positioned in an first fluid introduction position then the second inlet of said first fluid entry valve is in fluid communications with the outlet of said first fluid entry valve;

a first tube having an inlet and an outlet, the inlet of said first tube is operatively attached to the outlet said first fluid entry valve, the outlet of said first tube is operatively attachable to the first intake port of the first engine;

a second conduit having an inlet and an outlet, the inlet of said second conduit is operatively attached to the second outlet said tri-junction conduit connector;

a second shutoff valve having an inlet, an outlet and a second shutoff gate, the inlet of said second shutoff valve is operatively attached to the outlet of said second conduit, when the second shutoff gate of said second shutoff valve is positioned in a second open position then the inlet and outlet of said second shutoff valve are in fluid communications with each other, when the second shutoff gate of said second shutoff valve is positioned in a second closed position then the inlet and outlet of said second shutoff valve are not in fluid communications with each other;

a second bypass valve having a first inlet, a second inlet, an outlet, and a second bypass gate, the first inlet of said second bypass valve is operatively attached to the outlet of said second shutoff valve, the second inlet of said second bypass valve is operatively attachable to an outlet of the second onboard cooling line, when the second bypass gate of said second bypass valve is positioned in a second bypass position then the first inlet of the second bypass valve is in fluid communications with the outlet of said second shutoff valve, when the second bypass gate of said second bypass valve is positioned in a second flow through position and when the second inlet of said second bypass valve is operatively attached to the outlet of the second onboard cooling line then the second inlet of the second bypass valve is in fluid communications with the outlet of the second onboard cooling line;

a second fluid entry valve having a first inlet, a second inlet, an outlet and a second fluid entry gate, the first inlet of said second fluid entry valve is operatively attached to the outlet of said second bypass valve, when the second fluid entry gate of said second fluid entry valve is positioned in a second detour position then the first inlet of said second fluid entry valve is in fluid communications with the outlet of said second fluid entry valve, when the second fluid entry gate of said second fluid entry valve is positioned in a second fluid introduction position then the second inlet of said second fluid entry valve is in fluid communications with the outlet of said second fluid entry valve; and a second tube having an inlet and an outlet, the inlet of said second tube is operatively attached to the outlet said second fluid entry valve, the outlet of said second tube is operatively attachable to the second intake port of the second engine.

2. The device of claim 1 further comprising a first funnel having a bottom end operatively attachable to the second inlet of said first fluid entry valve.

3. The device of claim 1 further comprising a first funnel having a bottom end operatively attached to the second inlet of the first fluid entry valve.

4. The device of claim 1 further comprising a second funnel having a bottom end operatively attachable to the second inlet of said second fluid entry valve.

5. The device of claim 1 further comprising a second funnel having a bottom end operatively attached to the second inlet of said second fluid entry valve.

6. The device of claim 1 wherein said tri-junction conduit is a T-junction conduit.

7. The device of claim 1 wherein said tri-junction conduit is a Y-junction conduit.

8. The device of claim 1 wherein said device is made of plastic.

9. A method of using an engine flushing device for purging existing water trapped within respective cooling chambers of a first and second engines of a boat, the first and second engines having respective first and second intake ports connected to respective first and second onboard cooling lines, said method comprising the steps of:

obtaining the engine flushing device comprising:

a tri-junction conduit connector having a first outlet, a second outlet and an inlet, the inlet of the tri-junction conduit connector is operatively attachable to an outlet of a garden hose;

a first conduit having an inlet and an outlet, the inlet of the first conduit is operatively attached to the first outlet the tri-junction conduit connector;

a first shutoff valve having an inlet, an outlet and a first shutoff gate, the inlet of the first shutoff valve is operatively attached to the outlet of the first conduit, when the first shutoff gate of the first shutoff valve is positioned in a first open position then the inlet and outlet of the first shutoff valve are in fluid communications with each other, when the first shutoff gate of the first shutoff valve is positioned in a first closed position then the inlet and outlet of the first shutoff valve are not in fluid communications with each other;

a first bypass valve having a first inlet, a second inlet, an outlet, and a first bypass gate, the first inlet of the first bypass valve is operatively attached to the outlet of the first shutoff valve, the second inlet of the first bypass valve is operatively attachable to an outlet of the first onboard cooling line, when the first bypass gate of the first bypass valve is positioned in a first bypass position then the first inlet of the first bypass valve is in fluid communications with the outlet of the first shutoff valve, when the first bypass gate of the first bypass valve is positioned in a first flow through position and when the second inlet of the first bypass valve is operatively attached to the outlet of the first onboard cooling line then the second inlet of the first bypass valve is in fluid communications with the outlet of the first onboard cooling line;

a first fluid entry valve having a first inlet, a second inlet, an outlet and a first fluid entry gate, the first inlet of the first fluid entry valve is operatively attached to the outlet of the first bypass valve, when the first fluid entry gate of the first fluid entry valve is positioned in a first detour position then the first inlet of the first fluid entry valve is in fluid communications with the outlet of the first fluid entry valve, when the first fluid entry gate of the first fluid entry valve is positioned in an first fluid introduction position then the second inlet of the first fluid entry valve is in fluid communications with the outlet of the first fluid entry valve;

a first tube having an inlet and an outlet, the inlet of the first tube is operatively attached to the outlet the first fluid entry valve, the outlet of the first tube is operatively attachable to the first intake port of the first engine;

a second conduit having an inlet and an outlet, the inlet of the second conduit is operatively attached to the second outlet the tri-junction conduit connector;

a second shutoff valve having an inlet, an outlet and a second shutoff gate, the inlet of the second shutoff valve is operatively attached to the outlet of the second conduit, when the second shutoff gate of the second shutoff valve is positioned in a second open position then the inlet and outlet of the second shutoff valve are in fluid communications with each other, when the second shutoff gate of the second shutoff valve is positioned in a second closed position then the inlet and outlet of the second shutoff valve are not in fluid communications with each other;

a second bypass valve having a first inlet, a second inlet, an outlet, and a second bypass gate, the first inlet of the second bypass valve is operatively attached to the outlet of the second shutoff valve, the second inlet of the second bypass valve is operatively attachable to an outlet of the second onboard cooling line, when the second bypass gate of the second bypass valve is positioned in a second bypass position then the first inlet of the second bypass valve is in fluid communications with the outlet of the second shutoff valve, when the second bypass gate of the second bypass valve is positioned in a second flow through position and when the second inlet of the second bypass valve is operatively attached to the outlet of the second onboard cooling line then the second inlet of the second bypass valve is in fluid communications with the outlet of the second onboard cooling line;

a second fluid entry valve having a first inlet, a second inlet, an outlet and a second fluid entry gate, the first inlet of the second fluid entry valve is operatively attached to the outlet of the second bypass valve, when the second fluid entry gate of the second fluid entry valve is positioned in a second detour position then the fist inlet of the second fluid entry valve is in fluid communications with the outlet of the second fluid entry valve, when the second fluid entry gate of the second fluid entry valve is positioned in a second fluid introduction position then the second inlet of the second fluid entry valve is in fluid communications with the outlet of the second fluid entry valve;

a second tube having an inlet and an outlet, the inlet of the second tube is operatively attached to the outlet the second fluid entry valve, the outlet of the second tube is operatively attachable to the second intake port of the second engine;

adjoining operatively together the second inlet of the first bypass valve of the device to the outlet of the first onboard cooling line;

affixing operatively together the second inlet of the second bypass valve of the device to the outlet of the second onboard cooling line;

conjoining operatively together the outlet of the first tube of the device to the first intake port of the first engine;

coupling operatively together the outlet of the second tube of the device to the second intake port of the second engine, wherein said steps of adjoining, affixing, conjoining, and coupling comprise attaching the device onto the boat;

connecting operatively together an inlet of the garden hose to a water faucet;

mating operatively together the outlet of the garden hose to the inlet of the tri-junction conduit connector of the attached device;

aligning the first shutoff gate of the first shutoff valve of the attached device into the first open position;

placing the first bypass gate of the first bypass valve of the attached device in the first bypass position;

positioning the second bypass gate of the second bypass valve of the attached device in the second bypass position;

moving the first fluid entry gate of the first fluid entry valve of the attached device in the first detour position;

lining up the second fluid entry gate of the second fluid entry valve of the attached device in the second detour position, wherein said steps of aligning, lining, mating, placing, and positioning comprise configuring the attached device into a flushing mode;

turning on the water faucet when the device is in the flushing mode; and running the first and second engines when the device is in the flushing mode, said step of running is performed subsequent to said turning step.

10. The method of claim 9 further comprising finding a first funnel having a bottom end;

getting a winterizing solution;

mounting operatively the bottom end of the first funnel to the second inlet of the first fluid entry valve of the attached device;

pouring an aliquot of the winterizing solution into the first funnel operatively mounted to the second inlet of the first fluid entry valve of the attached device;

placing the first bypass gate of the first bypass valve of the attached device in the first fluid introduction position when the first funnel is operatively mounted to the second inlet of the first fluid entry valve of the attached device and when pouring the aliquot of the wintering solution into the first funnel while running the first engine;

re-moving the first fluid entry gate of the first fluid entry valve of the attached device in the first detour position, said re-moving step performed subsequent to said placing step;

reposing operatively the bottom end of the first funnel to the second inlet of the second fluid entry valve of the attached device;

dispensing a portion of the winterizing solution into the first funnel operatively reposed to the second inlet of the second valve of the attached device;

setting the second bypass gate of the second bypass valve of the attached device in tie second fluid introduction position when the first funnel is operatively reposed to the second inlet of the second fluid entry valve of the attached device and when dispensing the portion of the winterizing solution into the first funnel while running the second engine; and realigning the second fluid entry gate of the second fluid entry valve of the attached device in the second detour position, said re-lining up step performed subsequent to said setting step.

11. The method of claim 10 further comprising the steps of:

disconnecting operatively the outlet of the garden hose from the inlet of the tri-junction conduit connector of the attached device.

12. The method of claim 11 further comprising the steps of:

switching the first shutoff gate of the first shutoff valve of the attached device from the first open position to the first closed position;

pivoting the second shutoff gate of the second shutoff valve of the attached device from the second open position to the second closed position;

twisting the first bypass gate of the first bypass valve of the attached device from the first bypass position to the first flow through position;

rotating the second bypass gate of the second bypass valve of the attached device from the second bypass position to the second flow through position;

assuring that the first fluid entry valve is in the first detour position; and verifying that the second fluid entry valve of the attached device is in the second detour position.

13. The method of claim 12 further comprising the step of:

driving the boat in a body of water when the first shutoff gate of the first shutoff valve of the attached device is in the first closed position, when the second shutoff gate of the second shutoff valve of the attached device is in the second closed position, when the first bypass gate of the first bypass valve of the attached device is in the first flow through position, and when the second bypass gate of the second bypass valve of the attached device is in the second flow through position.

* * * * *